United States Patent [19]

Wilson

[11] Patent Number: 4,949,449

[45] Date of Patent: Aug. 21, 1990

[54] QUICK RELEASE ROTARY PUNCH

[75] Inventor: John S. Wilson, St. Louis, Mo.

[73] Assignee: Wilson Manufacturing Company, St. Louis, Mo.

[21] Appl. No.: 315,335

[22] Filed: Feb. 23, 1989

[51] Int. Cl.[5] ..... B26F 1/10

[52] U.S. Cl. ..... 29/402.08; 29/426.5; 83/345; 83/670; 83/698

[58] Field of Search ..... 83/345, 670, 669, 698, 83/665; 279/76, 79; 29/402.08, 426.5, 426.6

[56] References Cited

U.S. PATENT DOCUMENTS

| | | | |
|---|---|---|---|
| 1,179,476 | 4/1916 | Thomas | 83/698 |
| 1,472,833 | 11/1923 | Herold | 29/427 |
| 1,946,063 | 2/1934 | Dodge | 29/426.5 |
| 3,191,909 | 6/1965 | Reischl | 29/426.5 |
| 3,828,632 | 8/1974 | Grano | 83/345 |
| 4,174,648 | 11/1979 | Wallis | 83/698 |
| 4,377,100 | 3/1983 | Wallis | 83/698 |
| 4,548,113 | 10/1985 | Töpperwien et al. | 83/345 |
| 4,558,620 | 12/1985 | Wallis | 83/698 |
| 4,604,931 | 8/1986 | Bastian et al. | 83/665 |
| 4,688,459 | 8/1987 | Osborn et al. | 83/698 |

FOREIGN PATENT DOCUMENTS

| | | | |
|---|---|---|---|
| 688247 | 6/1964 | Canada | 83/698 |

*Primary Examiner*—Douglas D. Watts
*Assistant Examiner*—John M. Husar
*Attorney, Agent, or Firm*—Senniger, Powers, Leavitt and Roedel

[57] ABSTRACT

A rotary punch including a punch wheel rotatable on a central axis, the wheel having an end face lying in a radial plane of the wheel and an outer generally cylindric rim surface extending generally axially of the wheel. A plurality of radial bores in the wheel extend generally radially inwardly from the rim surface at intervals spaced circumferentially of the wheel, and a corresponding plurality of axial bores in the wheel extend generally axially inwardly from said end face of the wheel intersecting the radial bores generally at right angles. A plurality of generally cylindric punch elements are inserted in the radial bores, each punch element having a circumferential groove. A plurality of retainer pins in the axial bores may be moved axially between an extended position in which each retainer pin extends into a corresponding radial bore and is received in the circumferential groove in a respective punch element for holding the punch element in fixed radial position in its radial bore, and a retracted position in which the retainer pin is clear of the groove for enabling removal of the punch element from the radial bore. A coil spring biases each retainer pin toward its extended position. A tool is provided to pry any one of the retainer pins for moving it against the bias of the spring from its extended position to its retracted position to permit removal of a respective punch element from the wheel.

17 Claims, 1 Drawing Sheet

QUICK RELEASE ROTARY PUNCH

BACKGROUND OF THE INVENTION

This invention relates generally to rotary punches and more particularly to rotary punches with releasable punch elements.

The use of rotary punches to perforate a web of material, such as paper or cardboard, is well known. A problem with rotary punches has been that the punch elements frequently are broken or become dulled in continuous use and need to be replaced. Because not all of the punch elements require replacement at the same time, some punch wheels are constructed to releasably hold the punch elements so that they may be individually removed and replaced. Examples of such constructions are shown in U.S. Pat. Nos. 4,688,459 (Osborn et al.), 4,604,931 (Bastian et al.), 3,828,632 (Grano), 4,558,620 (Wallis), 4,174,648 (Wallis) and 4,377,100 (Wallis), each of which generally discloses punch wheel having a pin or ball which is received in a cavity in the punch wheel near each punch element. The pin or ball is movable and spring biased against the punch element to hold the punch element in the wheel. The punch elements are released by pulling on the punch element itself, inserting a tool into the punch wheel to disengage the pin or ball from the punch, or pressing a button on the punch wheel to release the punch element. However, these designs have one or more drawbacks, including complexity of construction and failure to positively lock the punch elements in the punch wheel while still allowing damaged punch elements to be removed with a minimum of effort.

SUMMARY OF THE INVENTION

Among the several objects of this invention is the provision of a rotary punch in which individual punch elements may be positively but releasably locked; the provision of such a rotary punch from which the punch elements may be quickly removed with a minimum of effort; the provision of such a rotary punch which is of simplified construction and relatively inexpensive to manufacture; and the provision of a method for releasably locking a punch element in a punch wheel of a rotary punch.

Generally described, the quick release rotary punch of this invention includes a punch wheel rotatable on a central axis. The wheel has an end face lying in a radial plane of the wheel and an outer generally cylindric rim surface extending generally axially of the wheel. A plurality of radial bores in the wheel extend generally radially inwardly from the rim surface at intervals spaced circumferentially of the wheel. A corresponding plurality of axial bores in the wheel extend generally axially inwardly from the end face of the wheel and intersect the radial bores generally at right angles. A plurality of generally cylindric punch elements are adapted for insertion in the radial bores, each punch element having a circumferential groove. A plurality of retainer pins in the axial bores are adapted for axial movement between an extended position in which each retainer pin extends into a corresponding radial bore and is received in the circumferential groove in a respective punch element for holding the punch element in fixed radial position in its radial bore, and a retracted position in which the retainer pin is clear of the groove for enabling removal of the punch element from the radial bore. Spring means bias each retainer pin toward its extended position. Tool means is adapted for prying engagement with any one of the retainer pins for moving it against the bias of the spring means from its extended position to its retracted position to permit removal of a respective punch element from the wheel.

The method of this invention includes engaging a prying tool with a retainer pin and prying the retainer pin with the prying tool to move the retainer pin to its retracted position thereby removing the retainer pin from the radial bore. A punch element is then inserted in the radial bore and the prying force is relaxed so that the retainer pin moves back to the extended position projecting into the radial bore and engages the punch element in its groove for holding the punch element in fixed radial position in its radial bore.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF A PREFERRED EMBODIMENT

Figure 1:
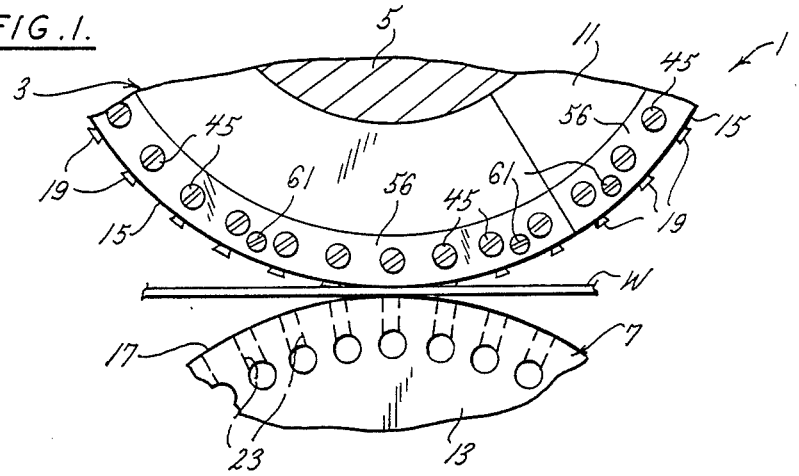
FIG. 1 is a fragmentary side elevation of a rotary punch constructed according to the principles of this invention.

Referring now to the drawings, a rotary punch, indicated generally at 1, comprises a punch wheel, indicated generally at 3, mounted on a shaft 5 for rotation on a central axis, and a die wheel 7 rotatable on a central axis parallel to the punch wheel axis. The punch wheel 3 and the die wheel 7 each have an end face 11, 13 lying in a radial plane of the respective wheel and an outer generally cylindric rim surface 15, 17 extending generally axially of the wheel. The punch wheel holds a plurality of generally cylindric punch elements, each indicated generally at 19, which project radially outward from the cylindric rim surface 15, and the die wheel has a number of radial bores 23 in its rim surface 17. As the wheels are rotated in directions opposite one another, the punch elements 19 are received in the die wheel radial bores 23 and simultaneously perforate a web of material W passing between the wheels.

Figure 2:
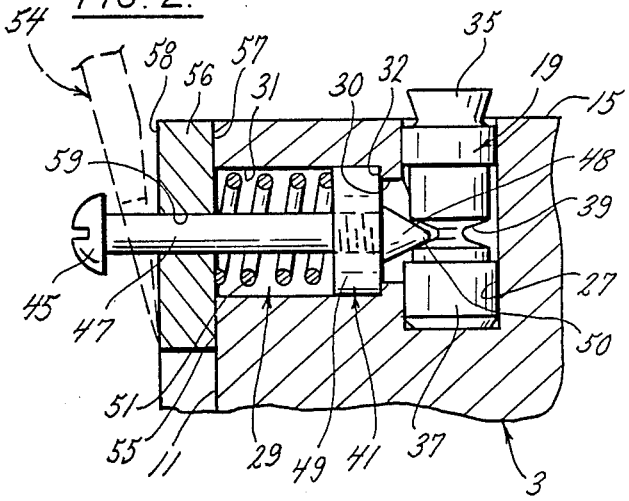
FIG. 2 is a fragmentary side cross section of a punch wheel showing a retainer pin in its extended position.

A plurality of radial bores 27 in the punch wheel 3 extend generally radially inwardly from the rim surface 15 at intervals spaced circumferentially of the punch wheel, and a corresponding plurality of axial bores, each generally designated 29, in the punch wheel extend generally axially inwardly from the end face 11 of the punch wheel and intersect the radial bores 27 generally at right angles. Each axial bore 29 includes a first bore portion 30 communicating with a corresponding radial bore 27 and a counterbore portion 31 which defines a shoulder 32 (See FIGS. 2 and 3). The punch elements 19 are adapted for insertion in the radial bores 27 of the punch wheel. Each punch element has a head 35, and a body 37 with a V-shaped circumferential groove 39 in it. The body 37 is received completely within the radial bore 27 when the punch element is inserted into the punch wheel, and the head 35 projects radially outward from the bore and the rim surface 15 of the punch wheel (FIG. 2).

Figure 3:
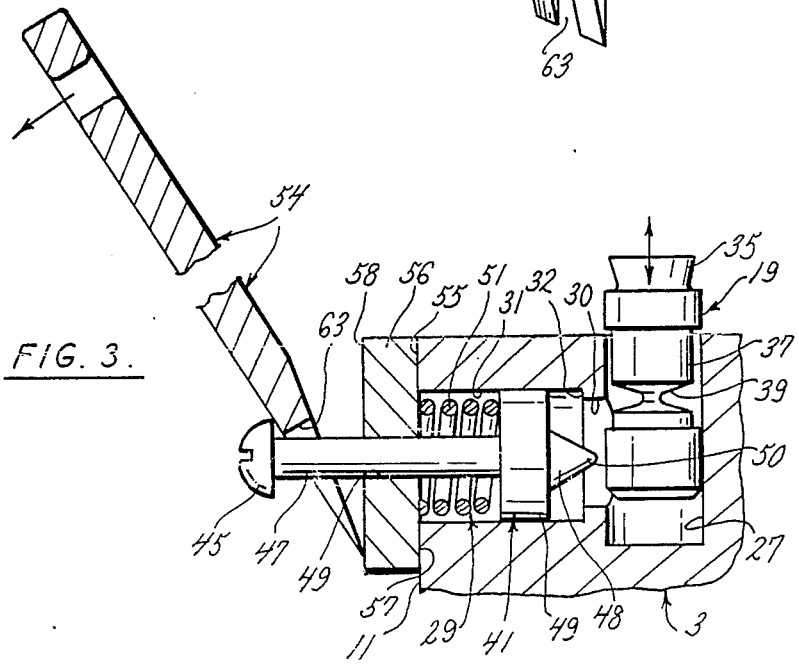
FIG. 3 is a view similar to FIG. 2 but showing the retainer pin pried by a prying tool to its retracted position.

A plurality of retainer pins, each indicated generally at 41 and each comprising a shank 45 and a head 47 at one end of the shank, are received in the axial bores 29 of the punch wheel 3 with the head of each retainer pin disposed outside its respective axial bore. Each retainer pin 41 is adapted for axial movement between an extended position in which the retainer pin extends into a corresponding radial bore 27 and is received in the circumferential groove 39 in a respective punch element 19 for holding the punch element in fixed radial position in its radial bore (FIG. 2), and a retracted position in which the retainer pin is clear of the groove for enabling removal of the punch element from the radial bore (FIG. 3). An end piece 48 is threadably mounted on an end of the shank 47 and may be removed from the shank. The end piece 48 has a cylindric body 49 having a close clearance fit with the wall of the counterbore portion 31 of its respective axial bore 29 for guiding the retainer pin between its extended and retracted positions. The cylindric portion 49 of the end piece 48 is engageable with the shoulder 32 in its respective axial bore 29 when the retainer pin is in its extended position. The end piece also has a pointed tip 50 integral with the cylindric portion 49 which is received in the V-shaped circumferential groove 39 of the punch element when the retainer pin is in its extended position. The engagement of the pointed tip with the punch element positively locks the punch element in its radial bore 27 so that it may not be removed without moving the retainer pin 41 to its retracted position.

Figure 4:
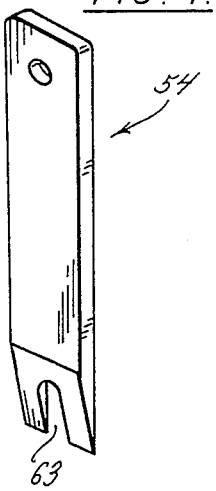
FIG. 4 is a perspective of the prying tool.

Spring means comprising a coil compression spring 51 around the shank 47 of each retainer pin 41 biases the retainer pin toward its extended position. Tool means, comprising a prying tool, shown in FIG. 4 and indicated generally at 54, is adapted for prying engagement with any one of the retainer pins 41 for moving it against the bias of the coil spring 51 from its extended position to its retracted position to permit removal or insertion of a punch element 19.

The axial bores 29 of the punch wheel 3 are located in a rabbetted annular surface 55 at the radially outer periphery of the end face 11. The rotary punch further includes means for holding the retainer pins in their respective axial bores, the means comprising annular plate means including two semi-annular retaining plates 56 each having an inner face 57 and an outer face 58 and a plurality of axial holes 59 spaced at intervals around the plate. The plates 56 are releasably secured to the punch wheel by means of fasteners 61 in a position where the plates are generally coaxial with the punch wheel. The inner faces 57 of the plates 56 engage the rabbetted surface 55 of the punch wheel, with the axial holes 59 in alignment with the axial bores 29 in the punch wheel. The shank 47 of each retainer pin 41 extends through a respective axial hole in a respective plate 56 and the head 45 of each retainer pin is engageable with the outer face 58 of the plate when the retainer pin is in its extended position. In each axial bore 29, the coil spring 51 engages the inner face 57 of one of the plates 56 at one end and the cylindric portion 49 of the end piece 48 at the other end. The spring is compressed in the axial bore 29 and thus exerts a biasing force on the retainer pin tending to move it to its extended position. The outer faces 58 of the plates 56 are flush with the end face 11 of the punch wheel and define a radially outer periphery of the end face.

The head 45 of each retainer pin 41 is disposed outside of its respective axial bore 29, the head and a portion of the shank 47 extending axially outward from the end face 11 and the retainer plate 56. The prying tool 54 is adapted to be inserted between the head 45 and the end face 11 of the punch wheel 3 for prying the retainer pin to its retracted position. The prying tool 54 is a generally rectangular lever having an end beveled to an edge having an arcuate notch 63 for receiving a portion of the retainer pin shank 47 when that end of the prying tool is inserted between the head of the retainer pin and the end face of the punch wheel. The edge of the beveled end of the prying tool 54 engages the end face 11 of the punch wheel at its outer periphery. As indicated in FIG. 3, the opposite end of the prying tool 54 is moved generally axially outward causing the tool to pivot on the edge of the beveled end, engage the head 45 of the retainer pin 41 and pry the retainer pin outward from its axial bore 29 against the bias of the coil spring 51.

The method of releasably locking a punch element 19 in the punch wheel 3 of this invention involves engaging the prying tool 54 with a retainer pin 41 and prying the pin with the prying tool to a retracted position in which the pointed tip 50 of the retainer pin end piece 48 is removed from the radial bore 27. A punch element is then inserted in the radial bore 27 and the prying force applied to the retainer pin is relaxed. The bias of the coil spring 51 moves the pin back to its extended position projecting into the radial bore and the pointed tip 50 engages the punch element in its groove 39 for holding the punch element in fixed radial position in its radial bore. The method further comprises steps for removing a damaged or dulled punch element including engaging the prying tool 54 with the retainer pin 41, prying the retainer pin with the prying tool for moving the retainer pin to the retracted position thereby disengaging the retainer pin from the punch element 19, and removing the punch element from the radial bore.

Thus is provided a punch wheel which securely and yet releasably holds the punch elements. The punch wheel requires only cylindric bores and a peripheral recess in its end face to provide for the punch element locking feature. The retaining pins, spring and holding plate are easily manufactured or assembled from readily available parts. Therefore, the punch wheel is of simplified construction and relatively inexpensive to manufacture. The method of this invention provides steps for quickly locking punch elements in the punch wheel and releasing the punch elements from the punch wheel so that damaged punch elements may be replaced without significant down time for the rotary punch.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A rotary punch comprising a punch wheel rotatable on a central axis, said wheel having an end face lying in a radial plane of the wheel and an outer generally cylindric rim surface extending generally axially of the wheel, a plurality of radial bores in the wheel extending generally radially inwardly from said rim surface at closely spaced intervals around the circumference of the wheel, a corresponding plurality of closely spaced axial bores in said wheel extending generally axially inwardly from said end face of the wheel and intersecting said radial bores generally at right angles thereto, a plurality of generally cylindric punch elements adapted for insertion in said closely spaced radial bores, each punch element having a circumferential groove therein, a plurality of retainer pins in said closely spaced axial bores adapted for axial movement between an extended position in which each retainer pin extends into a corresponding radial bore and is received in the circumferential groove in a respective punch element for holding the punch element in fixed radial position in its radial bore, and a retracted position in which the retainer pin is clear of the groove for enabling insertion of the punch element into the radial bore and removal of the punch element from the radial bore, spring means for biasing each retainer pin toward its extended position, means for holding the retainer pins in their respective axial bores, said holding means comprising annular plate means having an inner face, an outer face, a plurality of closely spaced axial holes therein spaced at intervals around the annular plate means, and means for releasably securing the annular plate means to the punch wheel in a position wherein the annular plate means is generally coaxial with the punch wheel with its inner face adjacent said end face of the punch wheel and said axial holes in alignment with said axial bores in the punch wheel, each retainer pin having a shank extending through a respective axial hole in the annular plate means, a head at one end of the shank disposed outwardly of the outer face of the annular plate means, and an end piece at the other end of the shank disposed in a respective axial bore in the punch wheel, and a prying tool for releasable prying engagement with the head of any one of the retainer pins for moving the retainer pin against the bias of said spring means from its extended position to its retracted position to permit insertion of a punch element into its respective radial bore and removal of the punch element from the radial bore.

2. The rotary punch as set forth in claim 1 wherein said prying tool comprises a generally rectangular lever having an end shaped to be inserted between the head of the retainer pin and said end face of the punch wheel.

3. The rotary punch as set forth in claim 2 wherein said end of the lever is beveled to an edge having an arcuate notch therein for receiving a portion of the retainer pin shank when said end is inserted between the head of the retainer pin and the end face of the wheel.

4. The rotary punch as set forth in claim 1 wherein the shank of each retainer pin has a generally pointed tip, and wherein the circumferential groove in each punch element is generally V-shaped, said pointed tip of the retainer pin being adapted to be received in the V-shaped groove of the punch element when the retainer pin is in said extended position for positively locking the punch element in its respective radial bore.

5. The rotary punch as set forth in claim 1 wherein said spring means comprises a coil compression spring around the shank of said retainer pin engageable at one end with the inner face of the annular plate means and at its other end with said end piece for biasing said retainer pin toward its extended position.

6. The rotary punch as set forth in claim 5 wherein said end piece is removably attached the shank of the retainer pin.

7. The rotary punch as set forth in claim 6 wherein said end piece has a generally cylindric portion having a close clearance fit in its respective axial bore in the punch wheel for guiding the retainer pin between its extended and retracted positions.

8. The rotary punch as set forth in claim 7 wherein said end piece has a pointed tip portion integral with said cylindric portion, said pointed tip portion being receivable in a cylindric groove in a respective punch element for positively locking said punch element in fixed radial position in its respective radial bore.

9. A rotary punch comprising a punch wheel rotatable on a central axis, said wheel having an end face lying in a radial plane of the wheel and an outer generally cylindric rim surface extending generally axially of the wheel, a plurality of closely spaced radial bores in the wheel extending generally radially inwardly from said rim surface at closely spaced intervals around the circumference of the wheel, a corresponding plurality of closely spaced axial bores in said wheel extending generally axially inwardly from said end face of the wheel and intersecting said radial bores generally at right angles thereto, a plurality of generally cylindrical punch elements adapted for insertion in said closely spaced radial bores, each punch element having a generally V-shaped circumferential groove therein, a plurality of retainer pins in said closely spaced axial bores, each retainer pin having a shank, a head and a generally pointed tip, the retainer pins being movable in their respective bores between an extended position in which each retainer pin extends into a corresponding radial bore and its pointed tip is received in the V-shaped circumferential groove in a respective punch element for positively locking the punch element in fixed radial position in its radial bore, and a retracted position in which the retainer pin is clear of the groove for enabling removal of the punch element from the radial bore and insertion of a replacement punch element into the radial bore, the head of each retainer pin being disposed outwardly of its respective axial bore for prying engagement by a prying tool for prying of the retainer pin to its said retracted position by the prying tool, and spring means for biasing each retainer pin toward its extended position.

10. The rotary punch as set forth in claim 9 further comprising means for holding the retainer pins in their respective axial bores.

11. The rotary punch as set forth in claim 10 wherein said holding means comprises annular plate means having an inner face, an outer face, and a plurality of axial holes therein spaced at intervals around the annular plate means, and means for releasably securing the annular plate means to the punch wheel in a position wherein the annular plate means is generally coaxial with the punch wheel with its inner face adjacent said end face of the punch wheel and said axial holes in alignment with said axial bores in the punch wheel, the shank of each retainer pin extending through a respective axial hole in the annular plate means and the head of the pin being disposed outwardly of the outer face of the annular plate means, and an end piece at the other end of the shank disposed in a respective axial bore in the punch wheel.

12. The rotary punch as set forth in claim 11 wherein said spring means comprises a coil compression spring around the shank of said retainer pin engageable at one end with the inner face of the annular plate and at its other end with said end piece for biasing said retainer pin toward its extended position.

13. The rotary punch as set forth in claim 12 wherein said end piece is removably attached to the shank of the retainer pin.

14. The rotary punch as set forth in claim 13 wherein said end piece has a generally cylindric portion having a close clearance fit in its respective axial bore in the punch wheel for guiding the retainer pin between its extended and retracted positions.

15. The rotary punch as set forth in claim 14 wherein said end piece has a pointed tip portion integral with said cylindric portion, said pointed tip portion being receivable in a cylindric groove in a respective punch element for positively locking said punch element in fixed radial position in its respective radial bore.

16. A method of releasably locking a punch element in a rotary punch wheel, the wheel having an end face lying in a radial plane of the wheel and an outer generally cylindric rim surface extending generally axially of the wheel, a plurality of radial bores in the wheel extending generally radially inwardly from said rim surface at intervals spaced circumferentially of the wheel, a corresponding plurality of axial bores in said wheel extending generally axially inwardly from said end face of the wheel and intersecting said radial bores generally at right angles thereto, and retainer pins slidably received in said axial bores, each retainer pin being biased by spring means toward an extended position in which it projects into a respective radial bore, said method comprising, engaging a prying tool with a retainer pin, prying the retainer pin with said prying tool for moving the retainer pin from said extended position to a retracted position in which the retainer pin is removed from said radial bore, inserting the punch element in the radial bore, relaxing the prying force applied by the prying tool on the retainer pin whereby the retainer pin moves back to said extended position projecting into the radial bore and engages the punch element in its groove for locking the punch element in fixed radial position in its radial bore, and disengaging the prying tool from the retainer pin.

17. The method as set forth in claim 16 further comprising using the prying tool to pry the retainer pin to its retracted position thereby to disengage the retainer pin from the punch element, and removing the punch element from the radial bore.

* * * * *